US006251847B1

(12) United States Patent
Pierce et al.

(10) Patent No.: US 6,251,847 B1
(45) Date of Patent: Jun. 26, 2001

(54) COMPOSITION AND METHOD FOR CLEANING/DEGREASING METAL SURFACES, ESPECIALLY COMPOSITES OF COPPER AND ALUMINUM

(75) Inventors: John R. Pierce, Huntington Woods; Lawrence R. Carlson, Waterford, both of MI (US)

(73) Assignee: Henkel Corporation, Gulph Mills, PA (US)

( * ) Notice: Subject to any disclaimer, the term of this patent is extended or adjusted under 35 U.S.C. 154(b) by 0 days.

(21) Appl. No.: 09/319,453

(22) PCT Filed: Nov. 28, 1997

(86) PCT No.: PCT/US97/20807

§ 371 Date: Jun. 7, 1999

§ 102(e) Date: Jun. 7, 1999

(87) PCT Pub. No.: WO98/24869

PCT Pub. Date: Jun. 11, 1998

Related U.S. Application Data

(60) Provisional application No. 60/032,530, filed on Dec. 6, 1996.

(51) Int. Cl.[7] ..... C11D 1/86; C11D 3/04; C11D 7/08; B05D 1/00

(52) U.S. Cl. ..... 510/365; 510/245; 510/254; 510/255; 510/420; 510/422; 134/2; 134/3; 134/40; 134/41

(58) Field of Search ..... 510/202, 254, 510/255, 245, 418, 269, 272, 433, 435, 471, 477, 478, 504; 134/2, 3, 18, 27–29, 40–41; 427/258, 265, 287

(56) References Cited

U.S. PATENT DOCUMENTS

| | | | | |
|---|---|---|---|---|
| 4,485,027 | * | 11/1984 | Rossmann et al. | 252/90 |
| 4,540,442 | * | 9/1985 | Smith et al. | 134/2 |
| 4,612,236 | * | 9/1986 | Hsu et al. | 428/216 |
| 4,678,605 | * | 7/1987 | Geke et al. | 252/547 |
| 5,018,482 | * | 5/1991 | Stanislowski | 119/173 |
| 5,356,555 | * | 10/1994 | Huth et al. . | |
| 5,391,234 | * | 2/1995 | Murphy | 134/38 |
| 5,696,171 | * | 12/1997 | Rupp et al. . | |
| 5,824,163 | * | 10/1998 | Murphy | 134/39 |
| 5,972,869 | * | 10/1999 | Cao et al. . | |
| 5,998,348 | * | 12/1999 | Murphy | 510/243 |

* cited by examiner

*Primary Examiner*—Yogendra N. Gupta
*Assistant Examiner*—Gregory E. Webb
(74) *Attorney, Agent, or Firm*—Wayne C. Jaeschke; Stephen D. Harper; Peter DeLuca

(57) ABSTRACT

An aqueous liquid composition for cleaning and degreasing metal surfaces consists essentially of water and the following dissolved stably dispersed, or both dissolved and stably dispersed components: A) alkali metal borate salts; B) boric acid in excess of any generated by reaction of anions of component a) with water; C) nonionic surfactant; and D) anionic and/or amphoteric surfactants.

18 Claims, No Drawings

COMPOSITION AND METHOD FOR CLEANING/DEGREASING METAL SURFACES, ESPECIALLY COMPOSITES OF COPPER AND ALUMINUM

CROSS-REFERENCE TO RELATED APPLICATION

Priority under 35 U.S.C. § 119(*e*) is claimed for this application from application Ser. No. 60/032,530 filed on Dec. 6, 1996.

BACKGROUND OF THE INVENTION

1. Field of the invention

The invention relates to a process for cleaning and/or degreasing metal surfaces, particularly aluminum and aluminum alloy metal surfaces, still more particularly those used for heat exchangers.

2. Statement of Related Art

Many mechanical operations such as stamping, cutting, welding, grinding, drawing, machining, and polishing are used in the metal working industry to provide shaped metal articles. In metal working operations, lubricants, antibinding agents, machining coolants and the like are normally utilized to prevent binding and sticking of the tools to the metal articles in the various metal working operations. The lubricants, coolants, and antibinding agents and the additives present in these compositions usually leave an oily, greasy, and/or waxy residue on the surface of the metal which has been worked. The residue normally should be removed before the worked articles are given a protective surface finish or incorporated into a finished assembly. Other kinds of soil, such as particulate metal salts dried on from a rinse water supply, or the like also may adhere to metal objects and need to be removed by cleaning that is not strictly "degreasing". Ordinarily, a single process that will remove all kinds of soil is desired; such a process is described herein as "cleaning/degreasing".

A wide variety of aqueous cleaners usually combining alkaline inorganic salts with surfactants have been known for this purpose. None has proved to be fully satisfactory for use on composite objects containing both copper elements and aluminum elements, which are frequently used in automotive radiators and some other heat exchanging equipment. Alkaline cleaners, if sufficiently strongly alkaline to clean at a practically satisfactory speed normally must be inhibited with silicate to prevent unwanted dissolution of at least one of the underlying metals, but the silicate often leaves a residue that interferes with subsequent brazing operations required to join the cleaned parts into a suitable finished assembly. Acidic cleaners only rarely excessively dissolve aluminum or copper, but in order to clean aluminum at a practical speed normally contain metal chelating agents such as citric acid, ethylenediaminetetraacetic acid, or nitrilotriacetic acid; these have been found to chelate substantial amounts of copper from copper surfaces exposed to them during cleaning, and the copper can not usually lawfully be discharged into effluent water so that expensive pollution abatement measures are required.

DESCRIPTION OF THE INVENTION

Object of the Invention

A major object of the invention is to provide a water-based liquid cleaner that is capable of satisfactorily cleaning/degreasing normally fabricated metal articles, especially those made of aluminum alloys containing substantial amounts of copper, at speeds at least as high as those of currently used cleaners, while reducing pollution problems and not adversely affecting subsequent joining processes. Other objects are to provide a more economical process, a faster process and/or one requiring less expensive equipment for operation on a large scale.

General Principles of Description

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred. Also, throughout the specification and claims, unless expressly stated to the contrary: percents, "parts of", and ratio values are by weight; the term "polymer" includes "oligomer", "copolymer", "terpolymer", and the like; the description of a group or class of materials as suitable or preferred for a given purpose in connection with the invention implies that mixtures of any two or more of the members of the group or class are equally suitable or preferred; description of electrically neutral constituents in chemical terms refers to the constituents at the time of addition to any combination specified in the description and/or by generation in situ by reactions described in the specification between already present and newly added material(s), and does not necessarily preclude chemical interactions among the constituents of a mixture once mixed; specification of materials in ionic form implies the presence of sufficient counterions to produce electrical neutrality for the composition as a whole (any counterions thus implicitly specified should preferably be selected from among other constituents explicitly specified in ionic form, to the extent possible; otherwise such counterions may be freely selected, except for avoiding counterions that act adversely to the objects of the invention); and the term "mole" and its variations may be applied to elemental, ionic, and any other chemical species defined by number and type of atoms present, as well as to compounds with well defined molecules.

The term "aluminum" when used hereinafter, unless the context requires otherwise, is to be understood to include pure aluminum and all the alloys of aluminum that contain at least 45% of aluminum by weight.

SUMMARY OF THE INVENTION

One embodiment of the invention is an aqueous liquid composition that, in addition to water, comprises, preferably consists essentially of, or more preferably consists of, the following dissolved, stably dispersed, or both dissolved and stably dispersed components:

(A) a concentration of a component of alkali metal borate salts;

(B) a concentration of boric acid in excess of any generated by reaction of anions of component (A) with water;

(C) a concentration of a component of nonionic surfactant; and (D) a concentration of a component selected from the group consisting of anionic and amphoteric surfactants; and, optionally, one or more of:

(E) a concentration of a component of salts that are not part of any of the previously recited components;

(F) a component of organic compounds that are not part of any of the previously recited components and are liquid at 25° C.;

(G) a component of hydrotroping agent that is not part of any of the previously recited components; and (H) a component of organic corrosion inhibitors that are not part of any of the previously recited components.

In this description, "stably dispersed" means that the component so described can be dispersed by mixing, within 1 hour of its introduction into the liquid phase in which the component in question is described as stably dispersed, to produce a liquid mixture which has only one bulk phase detectable with unaided normal human vision and does not spontaneously develop any separate bulk phase detectable with normal unaided human vision within 24 hours, or preferably, with increasing preference in the order given, within 7, 30, 60, 90, 120, 180, 240, 300, or 360 days, of storage without mechanical agitation at 25° C. after being initially mixed. (The word "bulk" in the preceding sentence means that, to be considered as a bulk phase, a phase must occupy at least one volume of space that is sufficiently large to be visible with unaided normal human vision and is separated from at least one other phase present in the dispersion by a boundary surface that can be observed with unaided normal human vision. Therefore, a change of the composition from clear to hazy or from hazy to clear does not indicate instability of a dispersion within this definition, unless a separate liquid or solid phase develops in the mixture in at least one volume large enough to see independently with unaided normal human vision.) Also in this description, "alkali stable" when referring to a surfactant means that the surfactant is capable of coexisting at its critical micelle concentration in an aqueous solution also containing at least, with increasing preference in the order given, 5, 10, 15, 20, 25, or 29% sodium hydroxide, without any chemical reaction (except possibly for reversible neutralization) between the surfactant and the sodium hydroxide and without the formation any separate bulk phase detectable with normal unaided human vision within 24 hours, preferably, with increasing preference in the order given, within 7, 30, 60, 90, 120, 180, 240, 300, or 360 days, of storage without mechanical agitation at 25° C. after being initially mixed.

Compositional embodiments of the invention include liquid compositions ready for use as such in cleaning (i.e., "working compositions") and concentrates suitable for preparing working compositions by dilution with water. Some compositions can function as either working compositions or concentrates. Concentrates may be single package or multiple, usually dual, package in nature.

Process embodiments of the invention include at a minimum using a working composition according to the invention to remove soils from a metal substrate, and they may include other process steps, particularly those which are conventional in themselves preceding or following cleaning/degreasing in the prior art.

Compositions of the present invention are particularly useful for cleaning aluminum and copper composite substrates, but are also useful for cleaning articles fabricated from metals such as steel, stainless steel, magnesium, titanium, tantalum, and other metals which are machined or worked during their fabrication into useful articles.

In addition to the above noted necessary and optional materials, compositions of the present invention can additionally contain antifoam agents, germicides, preserving agents and the like.

DESCRIPTION OF PREFERRED EMBODIMENTS

For a variety of reasons, it is preferred that compositions according to the invention as defined above should be substantially free from many ingredients used in compositions for similar purposes in the prior art. Specifically, it is increasingly preferred in the order given, independently for each preferably minimized component listed below, that these compositions, when directly contacted with metal in a process according to this invention, contain no more than 1.0, 0.35, 0.10, 0.08, 0.04, 0.02, 0.01, 0.001, or 0.0002, percent of each of the following constituents: any metal cations with a valence of 2 or higher, any metal containing anions; any fluorine containing anions; silica; silicates; thiourea; pyrazole compounds; and any organic compounds containing a moiety conforming to the general formula $R—(C)_x—R'$, where x is either 2 or 3 and each of R and R', which may be the same or different, is selected from the group consisting of hydroxyl, amino, phosphino, thiyl, carboxyl, carboxylate, or carbonyl.

In a working composition according to the invention, the pH preferably is, with increasing preference in the order given, at least 3.0, 3.5, 3.8, 4.0, 4.2, 4.4, 4.6, 4.70, 4.80, 4.90, 5.00, 5.10, 5.20, or 5.28 and independently preferably is, with increasing preference in the order given, not more than 7.1, 6.9, 6.7, 6.5, 6.3, 6.1, 5.9, 5.70, 5.50, 5.40, or 5.32.

Component (A) may be selected from any of the simple and condensed borate salts of the alkali metals. Salts of orthoboric acid (i.e., $H_3BO_3$) are preferred, and independently potassium salts are preferred over those of the other alkali metals, with sodium next most preferred. Component (A) may conveniently be, and usually preferably is, supplied by adding the appropriate boric acid in an amount in excess of that finally desired in the composition and neutralizing the desired fraction of it with an alkali metal oxide, carbonate, and/or hydroxide, which for purposes of calculation of preferred amounts herein is assumed to neutralize all of the hydrogen atoms in each boric acid molecule, to the extent stoichiometrically possible with the amount of alkali metal oxide, carbonate, and/or hydroxide added. The concentration of component (A) in a concentrate composition according to the invention preferably is at least, with increasing preference in the order given, 10, 20, 30, 40, 50, 60, 70, 80, 90, 95, or 100 millimoles per kilogram (hereinafter usually abbreviated as "mM/kg") and independently preferably is not more than, with increasing preference in the order given, 2.0, 1.5, 1.0, 0.90, 0.80, 0.70, 0.60, 0.50, 0.40, 0.30, 0.25, 0.20, 0.17, 0.15, 0.13, or 0.11 moles per kilogram (hereinafter usually abbreviated as ("M/kg").

Component (B) is preferably the same acid or mixture of acids the salts of which constitute component (A). For purposes of calculating preferred amounts, the effective concentration of component (B) is assumed to exclude any amount added which would be assumed to be neutralized as described in the immediately preceding paragraph. The concentration of component (B) preferably is such that the molar ratio of the effective concentration of component (B) to the concentration of component (A) present in a composition according to the invention is at least, with increasing preference in the order given, 0.5:1.0, 0.7:1.0, 0.9:1.0, 1.1:1.0, 1.3:1.0, 1.5:1.0, 1.60:1.0, 1.70:1.0, 1.80:1.0, 1.90:1.0, 2.00:1.0, 2.10:1.0, 2.20:1.0, 2.25:1.0, or 2.30:1.0 and independently preferably is not more than, with increasing preference in the order given, 10:1.0, 8:1.0, 6:1.0, 5.0:1.0, 4.0:1.0, 3.5:1.0, 3.1:1.0, 2.9:1.0, 2.7:1.0, 2.60:1.0, 2.50:1.0, 2.45:1.0, 2.40:1.0, or 2.37:1.0.

Component (C) is preferably selected from the group consisting of molecules conforming to the general formula $R^1—(C_2H_4O)_w—R^2$, where $R_1$ represents (i) an alkyl, aryl, or alkylaryl moiety or (ii) an alkyl-, aryl-, or alkylaryl-amino moiety containing an amino nitrogen atom that is chemically bonded directly to a $C_2H_4O$ moiety in the general formula, said alkyl, aryl, alkylaryl, or alkyl-, aryl-, or alkylaryl-amino moiety preferably having at least, with increasing preference in the order given, 5, 6, 8, 9, 10, 11, or 12 carbon atoms and independently preferably having not more than, with increasing preference in the order given, 22, 20, 18, 16, 14, or 13 carbon atoms; $R^2$ represents hydrogen or an alkyl, aryl, or alkylaryl moiety having no more than, with increasing preference in the order given, 8, 6, 4, 3, 2, or 1 carbon atom(s); and w represents a positive integer, which need not be the same for every molecule. The average value of w for all of the molecules in the composition conforming to this general formula, which average value need not be an integer, preferably is at least, with increasing preference in the order given, 2, 4, 5.0, 6.0, 7.0, 8.0, 8.5, or 8.9 and independently preferably is not more than, with increasing preference in the order given, 16, 14, 13.0, 12.0, 11.0, 10.5, 10.0, 9.5, or 9.1. The $R^1$ moiety independently more preferably is an alkyl moiety, without any aryl moieties or nitrogen atoms, and said alky moiety more preferably is primary (i.e., has two hydrogen and/or halogen atoms bonded to the carbon atom in the moiety with the free valence) and if primary still more preferably is linear, and the $R^1$ moiety independently more preferably has no substituent moieties, although it may have halogen or ether substituent moieties within the broad scope of the invention. The $R^2$ moiety independently more preferably is hydrogen. Numerous materials of highly preferred compositions are commercially available from condensation of ethylene oxide with various natural and synthetic primary alcohols, and other suitable although somewhat less preferred materials can be made by condensing ethylene oxide with amines. Independently of other preferences, the concentration of component (C) in a concentrate composition according to the invention preferably is at least, with increasing preference in the order given, 50, 100, 125, 150, 165, 175, 185, 195, 205, 215, 225, 230, or 235 grams per kilogram of total composition (hereinafter usually abbreviated as "g/kg") and independently preferably is not more than, with increasing preference in the order given, 750, 650, 550, 500, 450, 400, 350, 300, 270, 255, or 245 g/kg.

Component (D) preferably is selected from the group consisting of (i) molecules including a moiety that is a partial organic ester of phosphoric acid, a phosphonic acid, or sulfuric acid or a salt of any one of these types of partially acidic esters and (ii) amino acids and salts thereof. More preferably, it is selected from the group consisting of Alkali Surfactant JEN 2700™, commercially available from Tomah Chemical Products, Milton, Wis. and reported by its supplier to be a solution in water of about 35% of its surfactant ingredient, the monosodium salt of isodecyloxypropylaminodipropionic acid, an amphoteric surfactant, and SURMAX™ CS504, -515, -521, -522, -555, -586, -634, -684, -727, -772, and -786 surfactants, all commercially available from Chemax, Inc., Greenville, S.C. and reported by their supplier to be phosphorus containing amphoteric-anionic alkali stable surfactants, with other compositional information being proprietary. Independently of its chemical nature, the concentration of component (D) preferably is such as to give a ratio of the concentration of component (D) to the concentration of component (C) that is at least, with increasing preference in the order given, 0.02:1.0, 0.04:1.0, 0.06:1.0, 0.08:1.0, 0.10:1.0, 0.12:1.0, 0.14:1.0, 0.16:1.0, 0.18:1.0, 0.190:1.0, 0.200:1.0, or 0.210:1.0 and independently preferably is not more than, with increasing preference in the order given, 3.0:1.0, 2.0:1.0, 1.5:1.0, 1.0:1.0, 0.70:1.0, 0.50:1.0, 0.40:1.0, 0.35:1.0, 0.30:1.0, 0.25:1.0, or 0.22:1.0.

Among the optional components of compositions according to the invention only component (E) of additional salt is generally preferably present. The primary recognized function of this material is, along with components (A) and (B), to maintain the pH value of the composition within a suitable range, particularly as the composition is used. Because of the particular pH range desired, partially acid salts are generally preferred. Primarily for reasons of economy, partially acidic phosphate and condensed phosphate salts is are particularly preferred, with alkali metal diacid pyrophosphate salts most preferred. Independently, primarily for reasons of economy, sodium and potassium cations are preferred in these salts, with the former more preferred. The primary criterion for selecting the concentration of component (E) to be used, if any, is to achieve the pH value desired, but typically a composition according to the invention will contain about half as many moles of diacid pyrophosphate ions, for example, as it does moles of alkali metal cations in component (A).

Optional solvent component (F) is not ordinarily needed in a composition according to this invention and if not needed is preferably omitted, inasmuch as the extents of emission into the natural atmosphere of most of the chemical substances meeting the criteria for this component are legally restricted. However, in some specialized uses, such solvents may be needed for satisfactory results.

Optional hydrotroping component (G) also is not generally needed in most compositions according to this invention, in part because many of the preferred constituents of components (C) and, more particularly, (D) have some hydrotroping effect. Conventional hydrotroping agents such as the salts of alkyl benzene sulfonic acids, particularly of cumene sulfonic acid, are suitable for compositions to accomplish the cleaning/degreasing purposes of this invention unless the possibility of residual sulfur is objectionable; in that instance, alkyl and alkenyl substituted cyclic acid anhydrides, particularly the anhydrides of $C_{4-6}$ terminal dicarboxylic acids substituted with alkyl or alkenyl moieties having 6 to 20 carbon atoms are preferred. A particularly preferred example of this type of hydrotrope is nonenyl succinic anhydride.

Essentially any organic material known to have a corrosion inhibiting effect on the metal to be treated may be utilized in optional component (H) according to the invention as described above. The organic corrosion inhibitors most useful in the practice of the present invention are generally nitrogen or oxygen containing organic compounds, such as amines, nitro compounds, imidazoles, diazoles, triazoles, carboxylic acids, and the like. Particularly preferred inhibitors are (i) aromatic triazoles and their salts and (ii) complex carboxylic acids and their salts, preferably in a ratio of type (i) to type (ii) that is, with increasing preference in the order given, from 1:1 to 20:1, 3:1 to 10:1, or 4.5:1.0 to 5.5:1.0. When component (H) is present in a working composition according to this invention, its concentration preferably is, with increasing preference in the order given, at least 0.001, 0.002, 0.004, 0.008, 0.015, 0.030, 0.060, 0.12, 0.25, 0.35, 0.40, 0.45, 0.48, 0.52, 0.55, or 0.58 g/L and independently preferably is not more than, with increasing preference in the order given, 20, 10, 5, 4.5, 4.0, 3.6, 3.2, 2.8, 2.4, 2.0, 1.9, 1.8, 1.7, or 1.6 g/L.

When concentrate compositions according to the invention have one of the preferred concentrations of components (A) and (C) as specified above, a working composition made from such a concentrate preferably contains at least, with increasing preference in the order given, 0.3, 0.5, 0.7, 0.9, 1.1, 1.3, 1.5, 1.7, 1.9, 2.1, 2.3, 2.5, 2.7, or 2.9% of the concentrate composition and independently, primarily for reasons of economy, preferably contains not more than, with increasing preference in the order given, 10, 8, 7.0, 6.5, 6.0, 5.5, 5.0, 4.5, 4.2, 3.9, 3.6, or 3.3 % of the concentrate composition, with the balance water. Alternatively and independently of other preferences and each other, in a working composition according to the invention: the concentration of component (A) preferably is at least, with increasing preference in the order given, 0.3, 0.6, 0.9, 1.2, 1.5, 1.8, 2.1, 2.4, 2.7, 2.85, or 3.00 mM/kg and independently, primarily for reasons of economy, preferably is not more than, with increasing preference in the order given, 60, 45, 30, 27, 24, 21, 18, 15, 12, 9.0, 7.5, 6.0, 5.1, 4.5, 3.9, or 3.3 mM/kg; and the concentration of component (C) preferably is at least, with increasing preference in the order given, 1.5, 3.0, 3.7, 4.5, 5.0, 5.2, 5.6, 5.8, 6.0, 6.2, 6.4, 6.6, 6.8, 7.0, or 7.1 g/kg and independently, primarily for reasons of economy, preferably is not more than, with increasing preference in the order given, 70, 60, 50, 40, 33, 27, 19.0, 16.5, 15.0, 13.5, 12.0, 10.5, 9.0, 8.0, 7.5, or 7.3 g/kg.

Metal articles to be cleaned/degreased should be contacted with an aqueous cleaning/degreasing composition of the present invention at a sufficient temperature for a sufficient time to be effective for cleaning/degreasing. Contacting may be achieved by any convenient method or combination of methods and is most commonly accomplished either by immersing the object to be cleaned/degreased in a bath of a composition according to the invention or by spraying a composition according to the invention onto the surface of the object to be cleaned/degreased. For removing average type soils, the temperature during contact by immersion preferably is at least, with increasing preference in the order given, 30, 35, 38, 40, 42, 43.0, 44.0, 45.0, 46.0, 47.0, 48.0, or 48.9° C. and independently, primarily for reasons of economy, preferably is not more than, with increasing preference in the order given, 95, 90, 85, 80, 77, 75, 73, or 71° C., while if contact is by spraying the temperature during contact preferably is at least, with increasing preference in the order given, not less than 60, 65, 70, 73, 76, 79, or 82° C. and independently preferably is not more than the boiling temperature of the composition according to the invention, so that pressurization is not required. Higher temperatures generally provide a more rapid cleaning/degreasing and can be necessary when the soil comprises high melting point waxy type materials. The time of contact between the metal to be cleaned/degreased and a working composition according to this invention can vary over a wide range and can generally be selected by an operator with minimal experimentation. In a particularly important application, the cleaning of copper tubing-aluminum block radiator components, it is normal to clean by immersion in two to four successive baths of cleaning liquids of essentially the same composition, then use several more successive immersion rinses. In this application, two to three minutes in each separate bath of a composition according to the invention is usually preferred.

As is well understood in the art, after contact with a composition of the present invention to clean/degrease a metal article, the article can be processed in other usual steps such as deoxidizing, conversion coating, a conversion-coating-improving rinse liquid or "sealer", such as a hexavalent chromium containing aqueous solution for a phosphate conversion coating, and, if desired, the article can be coated with an organic or inorganic protective coating. All of the additional steps are well known in the art and may be required by a particular utility for the article which has been degreased. However, some metals will not require additional protective treatment and can be utilized after cleaning/degreasing according to this invention.

The following examples and comparison examples illustrate the compositions and methods of the present invention and their advantages. The examples are for illustrative purposes only and are not intended to limit the invention.

Concentrate Compositions

The ingredients and amounts of each ingredient used in these concentrate compositions are shown in Table 1. The sources of the ingredients in Table 1 not identified there by chemical names or formulas are given below, unless already given above herein.

The balance of ingredients not shown in Table 1 was water in all instances.

TABLE 1

CONCENTRATE COMPOSITIONS

| | Grams of Ingredient per Kilogram of Concentrate #: | | | | | | |
|---|---|---|---|---|---|---|---|
| Ingredient | 1 | 2 | 3 | 4 | 5 | 6 | 7 |
| Boric acid | 22.4 | 22.4 | 22.4 | 22.4 | 22.4 | 22.4 | 22.4 |
| 45% KOH in water | 20 | 20 | 20 | — | — | — | 33 |
| Potassium carbonate | — | — | — | 70 | 70 | — | — |
| BARLOX ™ 12i | 150 | 150 | 150 | 300 | 256 | 100 | 100 |
| NEODOL ™ 91-2.5 | 50 | 30 | 20 | 30 | 30 | — | — |
| NEODOL ™ 91-8 | — | — | — | — | — | 100 | 100 |
| NEODOL ™ 1-73B | | | | | | 60 | 60 |
| CHEMEEN ™ C-12G | — | — | 10 | — | — | — | — |
| CHEMAL ™ LA-9 | — | — | — | — | — | — | — |
| SURMAX ™ CS-684 | — | — | — | — | 30 | 60 | 60 |
| 60% $K_4P_2O_7$ in water | — | — | — | — | — | 50 | 30 |
| N-octyl pyrrolidone | — | — | — | — | — | 10 | 10 |

| | Grams of Ingredient per Kilogram of Concentrate #: | | | | | | | |
|---|---|---|---|---|---|---|---|---|
| Ingredient | 8 | 9 | 10 | 11 | 12 | 13 | 14 | 15 |
| Boric acid | 22.4 | 22.4 | 22.4 | 22.4 | 22.4 | 22.4 | 22.4 | 22.4 |
| 45% KOH in water | 30 | 30 | 40 | 40 | 40 | 33 | 30 | 40 |
| BARLOX ™ 12i | 100 | — | — | 400 | — | — | — | — |
| NEODOL ™ 91-8 | 100 | — | — | — | — | 240 | 240 | 240 |
| NEODOL ™ 1-73B | 60 | — | — | — | — | — | — | — |
| CHEMAL ™ LA-9 | — | — | 200 | — | 240 | — | — | — |
| SURMAX ™ CS-684 | 60 | 60 | 60 | — | 60 | 60 | 60 | 60 |
| 60% $K_4P_2O_7$ in water | 30 | 30 | 30 | 30 | — | 30 | 30 | — |
| $Na_2H_2P_2O_7$ | — | — | — | — | 30 | — | — | 30 |
| RHODA-MAX ™ LO | — | 300 | — | — | — | — | — | — |

BARLOX™ 12i was commercially supplied by Lonza Chemical and is reported by its supplier to be a 30% solution in water of branched long alkyl dimethylamine oxides. CHEMAL™ LA-9, CHEMEEN™ 12G, and SURMAX™CS684 surfactants were all commercially supplied by Chemax, Inc., Greenville, S.C. The first is reported by its supplier to be ethoxylates of lauryl alcohol, with an average of 9 ethylene oxide residue units per molecule; the second is reported by its supplier to be ethoxylates of cocoamines with an average of 12 ethylene oxide residue units per molecule; and the third is reported by its supplier to be a phosphorus containing, alkali stable, amphoteric and anionic low foaming surfactant with an acid value of 425, with all other compositional information proprietary. NEODOL™ 91-2.5, 91-8, and 1-73B surfactants were all commercially supplied by Shell Chemical Co. The first is reported by its supplier to be ethoxylates of linear primary alcohols with from 9 to 11 carbon atoms per molecule before ethoxylation, an average of 8 ethylene oxide residues per molecule after ethoxylation, and an HLB value of 12.5; the second is reported by its supplier to be ethoxylates of linear primary alcohols with from 9 to 11 carbon atoms per molecule before ethoxylation, an average of 2.5 ethylene oxide residues per molecule after ethoxylation, and an HLB value of 8.5; and the third is reported by its supplier to be a blend of ethoxylates of $C_{11}$ primary alcohol with an overall average of 5.6 ethylene oxide residues per molecule, achieved by blending two separate ethoxylates with average numbers of ethylene oxide residues per molecule of 3 and 7, and to have an overall HLB value of 11.2–12.3. RHODAMAX™ LO was commercially supplied by Rhône-Poulenc and is reported by its supplier to be a 29–31% solution in water of $C_{10-16}$ alkyldimethylamine oxides.

WORKING COMPOSITION AND USE EXAMPLES

Aqueous solutions of 3 volume % of most of the concentrates shown in Table 1 were prepared as working compositions and tested for cleaning aluminum panels soiled with known amounts of CEDARDRAW™ oil, a commonly used lubricant in processing aluminum sheets intended for fabrication into heat exchanger equipment. Tests were performed, unless otherwise noted, by immersing rectangular panels of Type 5052 aluminum sheet, 5.1×10.2 centimeters in size, into a bath of the working composition for 5 minutes, then removing the panel from the bath and immersing the panel ten times in succession in a bath of water, drying, and weighing to determine the amount of oil removed. Results are shown in Table 2, with the identifying numbers corresponding to the same number used for the concentrate in Table 1.

TABLE 2

| Identification # | pH of Working Composition | Grams of Oil Initially on Panel | Percent of Oil Not Removed |
|---|---|---|---|
| 1 | 9.0 | 0.0924 | 26 |
| 2 | 9.0 | 0.1016 | 43 |
| 3 | not measured | 0.0085 | 20 |
| 4 | not measured | 0.0107, 0.0140 | 5 (Notes 1,2) |
| 5 | not measured | 0.0108 | 26 (Note 2) |
| 6 | 2.3 | 0.0209 | 42 |
| 7 | 4.6 | 0.0153 | 15 |
| 8 | 4.1 | 0.0041, 0.0081 | 39 (Note 1) |
| 9 | 6.5 | 0.0034, 0.0092 | 32 (Note 1) |
| 10 | 6.4 | 0.0114, 0.0115 | 7.0 |
| 11 | 7.9 | 0.0094, 0.0134 | 28 |
| 12 | 5.2 | 0.0094, 0.0152 | 3.2 |
| 13 | 6.1 | not tested | not tested |
| 14 | 5.4 | 0.0149, 0.0073 | 8.5 |
| 15 | 5.2 | 0.0068, 0.0069 | 6.6 |
| Control (Note 3) | | 0.0163 | 4.9 |

Note 1: This value was the average of two tests.
Note 2: Gas bubbles, indicative of etching attack on the panel, were observed.
Note 3: The control was RIDOLINE ® 4380 degreaser, a current standard product for this and similar cleaning purposes, commercially available from the Henkel Surface Technologies Div. of Henkel Corp., Madison Heights, Michigan.

What is claimed is:

1. An aqueous acidic or neutral liquid composition that, in addition to water, consists essentially of the following dissolved, stably dispersed, or both dissolved and stably dispersed components:

(A) from about 10 mM/kg of total composition to about 2.0 M/kg of total composition of a component of alkali metal borate salts;

(B) a concentration of boric acid in excess of any generated by reaction of anions of component (A) with water, the concentration of component (B) having a ratio to the concentration of component (A) that is from about 0.5:1.0 to about 10:1.0;

(C) from 50 to 750 g/kg of total composition of a component selected from the group consisting of molecules conforming to the general formula $R^1$—$(C_2H_4O)_w$—$R^2$, where: $R^1$ represents (i) an alkyl, aryl, or alklaryl moiety or (ii) an alkyl-, aryl-, or alkylaryl-amino moiety containing an amino nitrogen atom that is chemically bonded directly to a $C_2H_4O$ moiety in the general formula, said alkyl, aryl, alkylaryl, or alkyl-, aryl-, or alkylaryl-amino moiety having from 5 to 22 carbon atoms; $R^2$ represents hydrogen or an alkyl, aryl, or alkylaryl moiety having no more than 8 carbon atoms; w represents a positive integer, which need not be the same for every molecule; and component (C) as a whole has an average value of w that is from about 2 to about 16; and (D) a concentration of a component selected from the group consisting of (D.1) molecules including a moiety that is a partial organic ester of an acid selected from the group consisting of (D.1.1) phosphoric acids, (D.1.2) phosphonic acids, and (D.1.3) sulfuric acid; (D.2) salts of partial esters that if present in acid form would be constituents of (D.1); and (D.3) amino acids and salts thereof that are not part of components (D.1) or (D.2), the concentration of component (D) having a ratio to the concentration of component (C) that is from about 0.02:1.0 to about 3.0:1.0.

2. An aqueous liquid composition according to claim 1, wherein: the concentration of component (A) is from about 30 mM/kg of total composition to about 0.90 M/kg of total composition; the concentration of component (B) has a ratio to the concentration of component (A) that is from about 0.9:1.0 to about 6:1.0; the concentration of component (C) is from 100 to 550 g/kg of total composition; the concentration of component (D) has a ratio to the concentration of component (C) that is from about 0.08:1.0 to 1.0:1.0; and the composition also contains a component (E) of salts that are not part of any of the previously recited components (A) through (D).

3. An aqueous liquid composition according to claim 2, wherein component (C) is selected from the group consisting of molecules conforming to the general formula $R^1$—$(C_2H_4O)_w$—$R^2$ when $R^1$ represents a moiety having from 8 to 20 carbon atoms, $R^2$ represents a moiety having no more than 4 carbon atoms, w represents a positive integer, and component (C) as a whole has an average value of w that is from about 5.0 to about 12.0.

4. An aqueous liquid composition according to claim 4, wherein: the concentration of component (A) is from about 50 mM/kg of total composition to about 0.70 M/kg of total composition; the concentration of component (B) has a ratio to the concentration of component (A) that is from about 1.3:1.0 to about 4.0:1.0; the concentration of component (C) is from 150 to 400 g/kg of total composition; the concentration of component (D) has a ratio to the concentration of component (C) that is from about 0.12:1.0 to about 0.50:1.0.

5. An aqueous liquid composition according to claim 6, wherein component (C) is selected from the group consisting of molecules conforming to the general formula $R^1$—$(C_2H_4O)_w$—$R^2$ when $R^1$ represents a moiety having from 10 to 18 carbon atoms, $R^2$ represents a moiety having no more than 2 carbon atoms, and component (C) as a whole has an average value of w that is from about 6.0 to about 11.0.

6. An aqueous liquid composition according to claim 5, wherein: the concentration of component (A) is from about 80 mM/kg of total composition to about 0.40 M /kg of total composition; the concentration of component (B) has a ratio to the concentration of component (A) that is from about 1.70:1.0 to about 3.1:1.0; the concentration of component (C) is from 185 to 350 g/kg of total composition; and the concentration of component (D) has a ratio to the concentration of component (C) that is from about 0.16:1.0 to about 0.35:1.0.

7. An aqueous liquid composition according to claim 6, wherein component (C) is selected from the group consisting of molecules conforming to the general formula $R^1$—$(C_2H_4O)_w$—$R^2$ when $R^1$ represents a moiety having from 12 to 14 carbon atoms, $R^2$ represents a moiety having no more than 1 carbon atom, and component (C) as a whole has an average value of w that is from about 8.0 to about 10.0.

8. An aqueous liquid composition according to claim 7, wherein: the concentration of component (A) is from about 90 mM/kg of total composition to about 0.20 M/kg of total composition; the concentration of component (B) has a ratio to the concentration of component (A) that is from about 2.20:1.0 to about 2.45:1.0; component (C) is selected from the group consisting of molecules conforming to the general formula $R^1$—$(C_2H_4O)_w$—$R^2$ when $R^1$ represents a linear primary alkyl moiety and $R^2$ represents a hydrogen atom; the concentration of component (C) is from 225 to 300 g/kg of total composition; the concentration of component (D) has a ratio to the concentration of component (C) that is from about 0.200:1.0 to about 0.25:1.0; and component (E) consists of alkali metal diacid pyrophosphate salts.

9. A process for cleaning/degreasing a soiled metal surface, said process comprising steps of:

(I) contacting the soiled metal surface with an aqueous liquid composition according to claim 3 for a sufficient time at a sufficient temperature to transfer soil from the soiled metal surface to the aqueous liquid composition, thereby generating a less soiled metal surface and a soil-containing aqueous liquid composition; and (II) separating the less soiled metal surface generated in step (I) from the soil-containing aqueous liquid composition also generated in step (I).

10. A process according to claim 9, wherein, in the aqueous composition used in step (I): there is a pH value from about 3.0 to about 7.1; the concentration of component (A) is from about 0.31 mM/kg of total composition to about 62 mM/kg of total composition; the concentration of component (B) has a ratio to the concentration of component (A) that is from about 0.5:1.0 to about 10:1.0; the concentration of component (C) is from 1.5 to 23 g/kg of total composition; and the concentration of component (D) has a ratio to the concentration of component (C) that is from about 0.02:1.0 to about 3.0:1.0.

11. A process according to claim 10, wherein, in the aqueous composition used in step (I):

component (C) is selected from the group consisting of molecules conforming to the general formula $R^1$—$(C_2H_4O)_w$—$R^2$, where: $R^1$ represents (i) an alkyl, aryl, or alkylaryl moiety or (ii) an alkyl-, aryl-, or alkylaryl-amino moiety containing an amino nitrogen atom that is chemically bonded directly to a $C_2H_4O$ moiety in the general formula, said alkyl, aryl, alkylaryl, or alkyl-, aryl-, or alkylaryl-amino moiety having from 5 to 22 carbon atoms; $R^2$ represents hydrogen or an alkyl, aryl, or alkylaryl moiety having no more than 8 carbon atoms; w represents a positive integer, which need not be the same for every molecule; and component (C) as a whole has an average value of w that is from about 2 to about 16; and component (D) is selected from the group consisting of (D.1) molecules including a moiety that is a partial organic ester of an acid selected from the group consisting of (D.1.1) phosphoric acids, (D.1.2) phosphonic acids, and (D.1.3) sulfuric acid; (D.2) salts of partial esters that if present in acid form would be constituents of (D.1); and (D.3) amino acids and salts thereof that are not part of components (D.1) or (D.2).

12. A process according to claim 11, wherein, in the aqueous composition used in step (I): there is a pH value from about 4.0 to about 6.9; the concentration of component (A) is from about 0.9 mM/kg of total composition to about 28 mM/kg of total composition; the concentration of component (B) has a ratio to the concentration of component (A) that is from about 0.9:1.0 to about 6:1.0; the concentration of component (C) is from 100 to 550 g/kg of total composition; the concentration of component (D) has a ratio to the concentration of component (C) that is from about 0.08:1.0 to 1.0:1.0; and the composition also contains a component (E) of salts that are not part of any of the previously recited components (A) through (D).

13. A process according to claim 12, wherein, in the aqueous composition used in step (I), component (C) is selected from the group consisting of molecules conforming to the general formula $R^1$—$(C_2H_4O)^w$—$R^2$ when $R^1$ represents a moiety having from 8 to 20 carbon atoms, R2 represents a moiety having no more than 4 carbon atoms, w represents a positive integer, and component (C) as a whole has an average value of w that is from about 5.0 to about 12.0.

14. A process according to claim 13, wherein, in the aqueous composition used in step (I): there is a pH value from about 4.4 to about 6.5; the concentration of component (A) is from about 1.6 mM/kg of total composition to about 22 mM/kg of total composition; the concentration of component (B) has a ratio to the concentration of component (A) that is from about 1.3:1.0 to about 4.0:1.0; the concentration of component (C) is from 4.6 to 12.4 g/kg of total composition; and the concentration of component (D) has a ratio to the concentration of component (C) that is from about 0.12:1.0 to about 0.50:1.0.

15. A process according to claim 14, wherein, in the aqueous composition used in step (I), component (C) is selected from the group consisting of molecules conforming to the general formula $R^1$—$(C_2H_4O)_w$—$R^2$ when $R^1$ represents a moiety having from 10 to 18 carbon atoms, $R^2$ represents a moiety having no more than 2 carbon atoms, and component (C) as a whole has an average value of w that is from about 6.0 to about 11.0.

16. A process according to claim 15, wherein, in the aqueous composition used in step (I): there is a pH value from about 4.6 to about 5.9; the concentration of component (A) is from about 2.5 mM/kg of total composition to about 12.4 mM/kg of total composition; the concentration of component (B) has a ratio to the concentration of component (A) that is from about 1.70:1.0 to about 3.1:1.0; the concentration of component (C) is from 5.7 to 10.8 g/kg of total composition; and the concentration of component (D) has a ratio to the concentration of component (C) that is from about 0.16:1.0 to about 0.35:1.0.

17. A process according to claim 16, wherein component (C) is selected from the group consisting of molecules conforming to the general formula $R^1$—$(C_2H_4O)_w$—$R^2$ when $R^1$ represents a moiety having from 12 to 14 carbon atoms, $R^2$ represents a moiety having no more than 1 carbon atom, and component (C) as a whole has an average value of w that is from about 8.0 to about 10.0.

18. A process according to claim 17, wherein, in the aqueous composition used in step (I): there is a pH value from about 5.20 to about 5.40; the concentration of component (A) is is from about 2.8 mM/kg of total composition to about 6.2 mM/kg of total composition; the concentration of component (B) has a ratio to the concentration of component (A) that is from about 2.20:1.0 to about 2.45:1.0; component (C) is selected from the group consisting of molecules conforming to the general formula $R^1$—$(C_2H_4O)_w$—$R^2$ when $R^1$ represents a linear primary alkyl moiety and $R^2$ represents a hydrogen atom; the concentration of component (C) is from 7.0 to 9.3 g/kg of total composition; the concentration of component (D) has a ratio to the concentration of component (C) that is from about 0.200:1.0 to about 0.25:1.0; and component (E) consists of alkali metal diacid pyrophosphate salts.

* * * * *

UNITED STATES PATENT AND TRADEMARK OFFICE

CERTIFICATE OF CORRECTION

PATENT NO. : 6,251,847 B1
DATED : June 26, 2001
INVENTOR(S) : Pierce et al.

It is certified that error appears in the above-identified patent and that said Letters Patent is hereby corrected as shown below:

Title page,
Item [57], ABSTRACT,
Line 3, insert a -- , -- after the word "dissolved".

Column 10,
Line 10, delete "alklaryl" and insert therefore -- alkylaryl --.

Column 12,
Line 27, delete "$R^1$—$(C_2H_4O)^w$—$R^2$"; and insert therefore -- $R^1$—$(C_2H_4O_w$—$R^2$ --.

Signed and Sealed this

Twenty-fourth Day of February, 2004

JON W. DUDAS
*Acting Director of the United States Patent and Trademark Office*